United States Patent [19]

Ikesue et al.

[11] Patent Number: 4,657,239

[45] Date of Patent: Apr. 14, 1987

[54] SHEET ALIGNING DEVICE

[75] Inventors: Masumi Ikesue; Yasuhiro Takahashi, both of Tokyo, Japan

[73] Assignee: Ricoh Company, Ltd., Tokyo, Japan

[21] Appl. No.: 633,118

[22] Filed: Jul. 20, 1984

[30] Foreign Application Priority Data

| | | | |
|---|---|---|---|
| Jul. 20, 1983 | [JP] | Japan | 58-132546 |
| Jul. 20, 1983 | [JP] | Japan | 58-132547 |
| Jul. 26, 1983 | [JP] | Japan | 58-135151 |

[51] Int. Cl.[4] ..... B65H 9/06

[52] U.S. Cl. ..... 271/227; 271/240; 271/248; 271/255

[58] Field of Search ..... 271/227, 228, 238, 239, 271/240, 248, 249, 250, 253, 254, 255, 221, 222, 3.1; 414/28; 198/434, 456

[56] References Cited

U.S. PATENT DOCUMENTS

| | | | |
|---|---|---|---|
| 2,986,262 | 5/1961 | Powers | 198/456 |
| 3,603,446 | 9/1971 | Maxey et al. | 271/227 X |
| 3,627,312 | 12/1971 | Fackler | 271/221 |
| 4,216,482 | 8/1980 | Mason | 271/227 X |
| 4,228,994 | 10/1980 | Volpe | 271/250 |
| 4,229,101 | 10/1980 | Hamlin et al. | 271/3.1 X |
| 4,359,219 | 11/1982 | Garavuso | 271/236 |
| 4,519,700 | 5/1985 | Barker et al. | 271/226 |

FOREIGN PATENT DOCUMENTS

| | | | |
|---|---|---|---|
| 0000302 | 1/1982 | Japan | 271/255 |
| 0184042 | 11/1982 | Japan | 271/227 |
| 0195063 | 11/1982 | Japan | 271/248 |
| 2034025 | 5/1980 | United Kingdom | 271/227 |

*Primary Examiner*—Andres Kashnikow
*Assistant Examiner*—M. C. Graham
*Attorney, Agent, or Firm*—Oblon, Fisher, Spivak, McClelland & Maier

[57] ABSTRACT

A sheet aligning device including a pair of side walls located parallel to each other and defining therebetween a space for stacking a plurality of sheets. At least one of the side walls is movable in reciprocatory movement widthwise of the sheets stacked between the side walls to force the sheets against the other side wall so as to align the sheets widthwise thereof which is perpendicular to the direction in which they are delivered. The sheet aligning device includes at least one sensor for sensing the magnitudes of displacements of the sheets widthwise thereof and producing an output for adjusting at least one of the frequency, speed and stroke of the reciprocatory movement of the at least one side wall in accordance with the magnitudes of the displacements.

5 Claims, 30 Drawing Figures

SHEET ALIGNING DEVICE

BACKGROUND OF THE INVENTION

This invention relates to a sheet aligning device having a pair of side walls located on opposite sides of a multiplicity of successively fed sheets at least one of which is movable in reciprocatory movement toward and away from the sheets widthwise thereof to bring the sheets into alignment with each other in a direction perpendicular to the direction in which the sheets are fed.

Copying apparatus, printers or their peripheral devices (such as automatic document feed devices, sheet folding machines, punching machines, sheet binding machines, etc.) usually comprise sheet aligning devices of the type described for aligning copies, printed sheets, documents and other sheets. In copying apparatus for copying opposite sides of a document, for example, copy sheets each having an image of an original formed on one side surface are placed on a tray of an intermediate sheet feeding device and then fed again therefrom. In this case, the copy sheets fed to the tray should be brought into alignment with each other widthwise thereof in a predetermined position.

The reason why it is necessary to bring the sheets into alignment with each other by a sheet aligning device is because sheets fed to a tray, for example, might be displaced, when they are delivered, from a predetermined position on which they are to be stacked widthwise of each other (a direction perpendicular to the direction in which the sheets are fed) with the superposed sheets either being aligned lengthwise thereof or skewed with respect to the direction in which they are fed. The widthwise displacement of the sheets may vary in magnitude depending on the material of the sheets, their surface smoothness, their size or ambient conditions (humidity, temperature). Some type of sheets might be displaced greatly while other type of sheets might not show displacement at all. The latter type of sheets can be readily handled by a sheet aligning device. However, difficulties are experienced in bringing the former type of sheets into alignment with each other.

In sheet aligning devices of the prior art, no consideration has been paid to the condition of the sheets before they are handled by the device and it has been customary to move the side walls at a uniform speed, frequency and stroke in reciprocatory movement in an attempt to align the sheets with each other. Thus, the devices of the prior art have suffered the disadvantage that they are unable to satisfactorily accomplish the object of aligning the sheets when the magnitudes of their displacements are great. To obviate this disadvantage, one only has to move the side walls in reciprocatory movement each time a sheet is fed so that the side walls will strike one sheet several times, to reduce the speed of movement of the side walls to facilitate alignment of the sheets or to increase the stroke of the side walls so that the side walls will shift the sheets with a greater force, so as to thereby bring the sheets into alignment with each other even if the magnitudes of their displacements are great. It will be possible to satisfactorily align the sheets if the operation is performed over a prolonged period of time by increasing the frequency of reciprocatory movement of the side walls or reducing the speed thereof. However, as noted hereinabove, the magnitudes of displacements of sheets may vary depending on the material of the sheets and other factors, and not all the types of sheets are displaced from each other a large magnitude. Thus, if the sheet aligning operation is performed over a prolonged period of time by increasing the frequency of reciprocatory movements of the side walls, a period of time longer than is necessary would have to be spent in handling sheets which show little or no displacements. A loss of time would be enormous when a multiplicity of sheets are handled if the frequency of movements of the side walls is increased or the time required for handling each sheet is prolonged. Also, as subsequently to be described in detail, the intervals at which the sheets are successively fed should be increased. An apparatus, such as a printer or a copying apparatus, equipped with this type of sheet aligning device of the prior art would suffer the disadvantage that its peripheral equipment is very low in efficiency.

SUMMARY OF THE INVENTION

This invention has been developed for the purpose of obviating the aforesaid disadvantages of the prior art. Accordingly, the invention has as one of its object the provision of a sheet aligning device capable of avoiding a loss of time in achieving alignment of the sheets without reducing the effects achieved in bringing them into alignment and performing sheet aligning operations satisfactorily without increasing the intervals at which the sheets are fed successively.

Another object is to provide a sheet aligning device capable of checking the condition in which the sheets have been handled by the sheet aligning device after a sheet aligning operation has been performed.

To accomplish the aforesaid objects, the invention provides outstanding characteristics including detecting means for checking the condition of sheets before being handled by the sheet aligning device to detect the sheets at least in one of two conditions including a widthwise displacement of the sheets which are aligned lengthwise and a widthwise displacement thereof which are out of alignment lengthwise, such detecting means producing an output capable of changing at least one of the frequency, speed and stroke of the reciprocatory movement of at least one of the side walls when a sheet aligning operation is performed, and another detecting means for checking the condition in which the sheets have been handled by the sheet aligning device to thereby avoid the disadvantage which might be suffered due to misalignment of the sheets.

DETAILED DESCRIPTION OF THE PREFERRED EMBODIMENTS

Preferred embodiments of the invention will now be described by referring to the accompanying drawings.

To enable the present invention to be fully understood, the construction of a copying apparatus for copying both side surfaces of a document on opposite surfaces of copy sheets will be described in a sectional view shown in FIG. 1.

Figure 1:
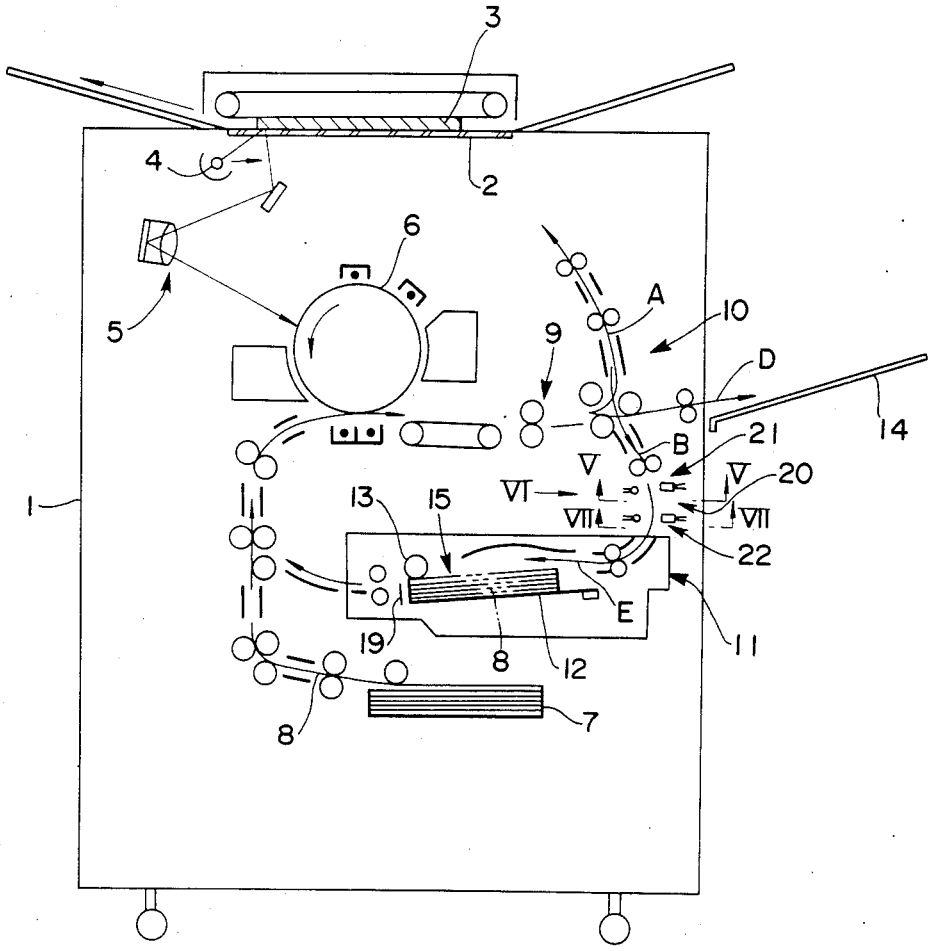
FIG. 1 is a view in explanation of a copying apparatus for copying both sides of a document equipped with the sheet aligning device comprising one embodiment of the invention.

The copying apparatus shown in FIG. 1 comprises a main body 1 having a contact glass member 2 secured to its top surface to have a document 3 placed thereon. The operator selects a both-surfaces copying mode and depresses a copy button, not shown, to move a light source 4 from the illustrated position rightwardly in FIG. 1. At this time, a light beam emanating from the light source 4 illuminates a top surface of the document 3 before the light source 4 is restored to its original position. The top surface of the document 3 illuminated by the light beam from the light source 4 reflects the light beam through an image forming optical system 5 comprising mirrors and lenses to expose a photosensitive member 6 rotating counter-clockwise to an optical image of the document 3, to thereby form an electrostatic latent image on a surface of the photosensitive member 6 which is developed into a visible image with a toner.

Meanwhile, a sheet 8 fed from a main sheet feeding device 7 is fed to a predetermined position in which the sheet 8 is indexed with the electrostatic latent images as it is delivered to the predetermined position in a transfer-printing station where the toner image on the photosensitive member 6 is printed by transfer-printing on a surface of the sheet 8. The sheet 8 having the toner image (visible image) of the document 3 on one surface thereof is passed through a fixing device 9 to have the image fixed on the sheet 8, to provide a one-surface copy sheet which is switched back as indicated by arrows A and B by an inverting device 10 after being released from the fixing device 9 and fed into a tray 12 of an intermediate sheet feeding device 11 as indicated by an arrow E.

The operation described hereinabove is repeatedly performed, and one-surface copy sheets are fed successively into the tray 12 at intervals. As the one-surface copy sheets 8 form a stack on the tray 12 in a predetermined number as indicated by two-dots between two-dashed lines, a sheet feeding roller 13 is brought into contact with the topmost sheet 8 and rotated clockwise to thereby feed one sheet after another to the transfer-printing station to have an image of the document 3 printed on an opposite side surface and fixed by the fixing device 9, before being discharged from the main body 1 as indicated by an arrow D onto a stacker 14.

As described hereinabove, the copy sheets 8 are successively placed on the tray 12 and temporarily stacked thereon. If the copy sheets 8 stacked on the tray 12 are misaligned, trouble would occur and the copy sheet might be brought out of index with the visible or toner image on the surface of the photosensitive member 6 when delivered to the predetermined position in the transfer-printing station. To avoid this trouble, a sheet aligning device 15 according to the invention is mounted in association with the tray 12 so as to align the copy sheets 8 widthwise thereof.

Figure 2:
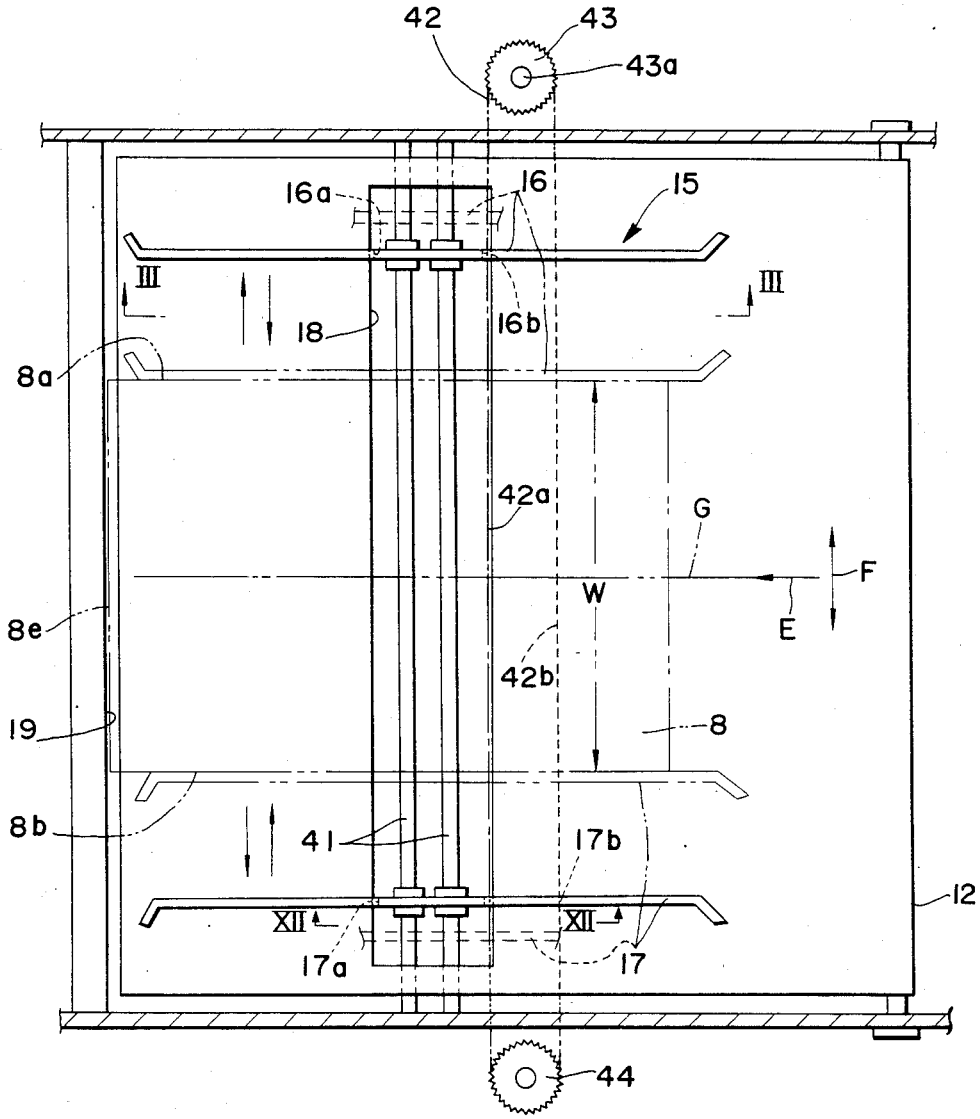
FIG. 2 is a fragmentary sectional plan view of an intermediate sheet feeding device equipped with the sheet aligning device according to the invention, with certain parts being removed.
Figure 3:
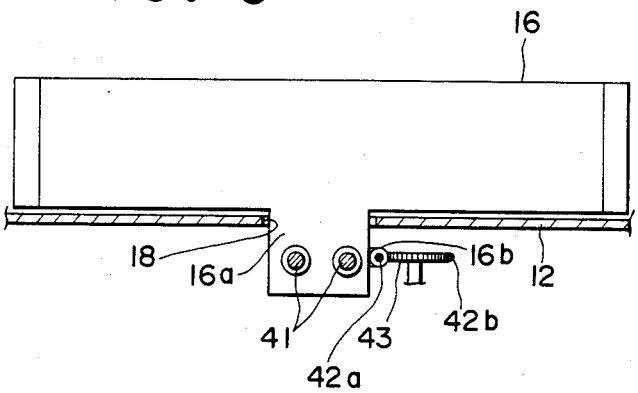
FIG. 3 is a sectional view taken along the line III—III in FIG. 2, with certain parts being omitted.
Figure 12:
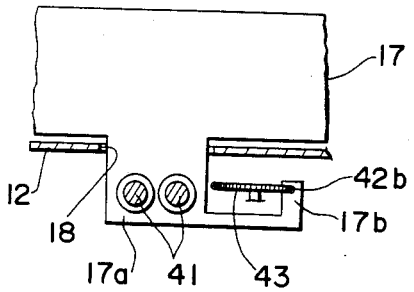
FIG. 12 is a sectional view similar to FIG. 3 but taken along the line XII—XII in FIG. 2.

FIG. 2 shows one embodiment of the sheet aligning device 15 in conformity with the invention comprising a pair of side walls 16 and 17 located on opposite lateral sides of the copy sheets 8 delivered to the tray 12. As shown in FIGS. 2, 3 and 12, the side walls 16 and 17 have bases 16*a* and 17*a*, respectively, which are fitted in a cutout 18 formed in the tray 12 and supported for movement in a direction F widthwise of the copy sheets 8 which is perpendicular to the direction E in which the copy sheets 8 are delivered to the tray 12. The side walls 16 and 17 are driven by a drive unit subsequently to be described to move toward and away from each other while being maintained in positions which are symmetrical with respect to a center reference line G between them.

As a copy sheet 8 is delivered to the tray 12, the side walls 16 and 17 are disposed in standby or inoperative positions shown in solid lines in FIG. 2 in which the spacing between them is greater than the width W of the copy sheet 8 so as to avoid the trouble that the copy sheet 8 might otherwise impinge on the side walls 16 and 17 and be prevented from entering the space defined therebetween.

The sheet aligning operation performed by the side walls 16 and 17 is as follows: The side walls 16 and 17 disposed in the standby or inoperative positions begin to move toward each other after the copy sheet 8 delivered in the direction of the arrow E has entered the space between them or immediately before entering the space between them. In the embodiment shown and described herein, the side walls 16 and 17 begin to move toward each other after a leading edge 8*e* of the copy sheet 8 impinges on a front striking bar 19 secured to a front edge of the tray 12 (on the left side in FIG. 2) and the copy sheet 8 is brought to a halt. The side walls 16 and 17 moving toward each other impinge on opposite lateral sides 8*a* and 8*b* of the copy sheet 8 respectively as shown in two-dots between two-dashed lines in FIG. 2 and then move away from each other back to the inoperative positions shown in solid lines. As the side walls 16 and 17 move in reciprocatory movement toward and away from the copy sheet 8 on the tray 12, the copy sheet 8 is brought to a position on the tray 12 in which a lengthwise center line of the copy sheet 8 perpendicular to the width F thereof is in alignment with the center reference line G between the side walls 16 and 17.

Figure 4A:
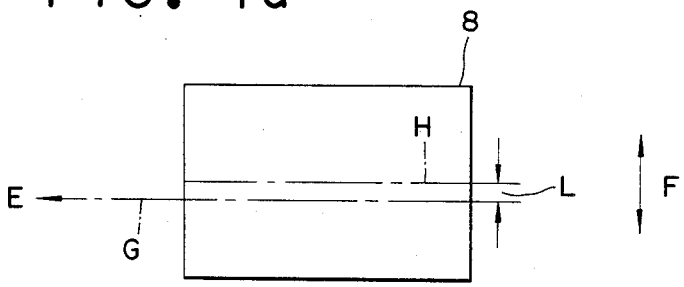
FIGS. 4*a* and 4*b* are views in explanation of conditions in which copy sheets are displaced.
Figure 4B:
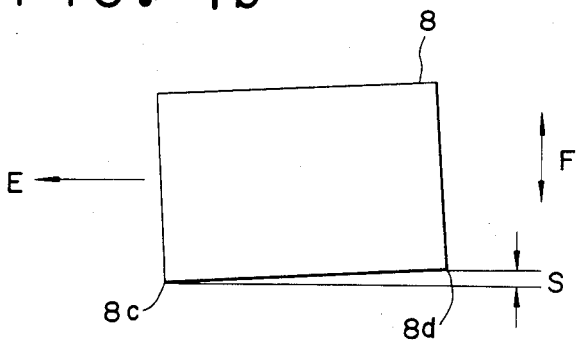

The reason why it is necessary to align the copy sheets 8 widthwise thereof F is because the copy sheets 8 delivered to the tray 12 are sometimes displaced or slanting widthwise thereof. FIG. 4*a* shows the copy sheet 8 displaced upwardly widthwise F in FIG. 4*a* although its lengthwise center line H perpendicular to the width F is parallel to the center reference line G. FIG. 4*b* shows the copy sheet 8 slanting or skewed with respect to the direction E in which it is delivered to the tray 12. As shown, a lateral side edge of the copy sheet 8 connecting a corner 8*c* at a leading edge and a corner 8*d* at a trailing edge together is slanting by a magnitude S with respect to the center reference line G. FIGS. 4*a* and 4*b* merely show the positions of the copy sheet for purposes of illustration, and in actual practice, the copy sheet 8 may be disposed in any other position. The direction in which the copy sheet 8 might be displaced and the magnitudes L and S of the displacements may vary depending on the material and size of the copy sheet 8 and the environmental condition under which copying operation is performed. In the prior art, it has been usual practice to move the side walls 16 and 17 at a standardized frequency, speed and stroke. This has given rise to the disadvantage that the copy sheets have not been aligned satisfactorily or a period of time longer than is necessary is required to perform sheet aligning operations, as noted hereinabove.

In the aligning device 15 shown, the magnitudes L and S of the displacements of the sheet 8 are detected by detecting means and the side walls 16 and 17 are moved in reciprocatory movement with a frequency, at a speed or with a stroke commensurate with the output of the detecting means or the magnitudes of displacements of the sheet 8, so that the effects of aligning the sheets 8 can be satisfactorily achieved while avoiding waste of time.

FIG. 1 shows detecting means 20 comprising a first detector 21 and a second detector 22 located in suitable position upstream of the sheet aligning device 15 with respect to the direction in which the sheets 8 are conveyed, or between the reversing device 10 and intermediate sheet feeding device 11. Alternatively, the detecting means 20 may be located in the position in which the sheet aligning device 15 is located.

Figure 5:
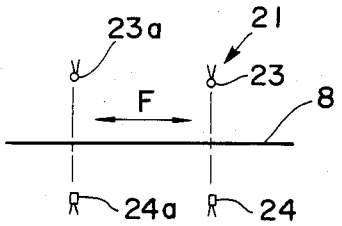
FIG. 5 is a view as seen in the direction of arrows V—V in FIG. 1, in explanation of the first detector of the first detecting means.
Figure 6:
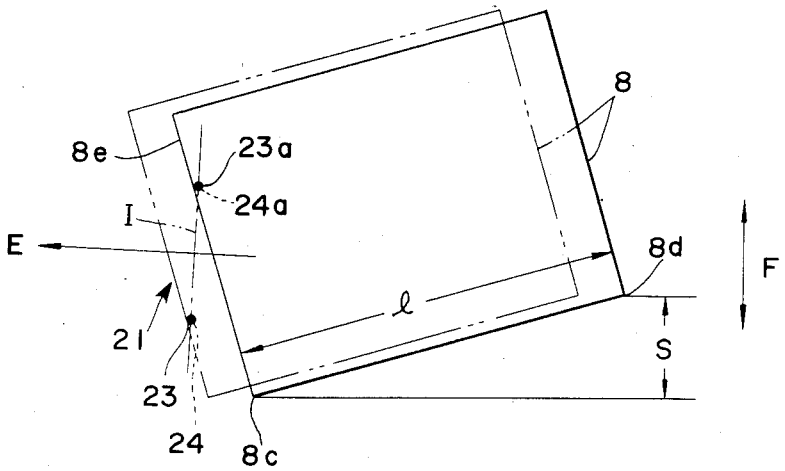
FIG. 6 is a view as seen in the direction of an arrow VI in FIG. 1, in explanation of the condition of operation of the first detector shown in FIG. 5.

The first detector 21 which detects skewing of the sheets 8 includes a photoelectric sensor composed of a first light source 23 and a first light receiving element 24 juxtaposed against each other, and another photoelectric sensor composed of a second light source 23*a* and a second light receiving element 24*a* juxtaposed against each other, as shown in FIGS. 5 and 6. The sheets 8 pass between the light sources 23 and 23*a* and the light receiving elements 24 and 24*a*. As shown in FIG. 6, the first light source and light receiving elements 23 and 24 and the second light source and light receiving element 23*a* and 24*a* are located in a plane I perpendicular to the direction E in which the sheets 8 are conveyed.

Assume that the sheet 8 is skewed with respect to the direction E in which the sheet 8 is conveyed and the skew of a lateral side of the sheet 8 connecting corners 8*c* and 8*d* together with respect to the direction E has a magnitude S, as shown exaggeratedly in FIG. 6. When the leading edge 8*e* of the sheet 8 reaches the detector 21, the sheet 8 first intercepts a light beam directed from the second light source 23*a* against the second light receiving element 24*a* as indicated by a solid line in FIG. 6, thereby keeping the light beam from being incident on the second light receiving element 24*a*. After a lapse of a certain period of time, the sheet 8 intercepts a light beam directed from the first light source 23 against the first light receiving element 24, as shown by two-dots between two-dashed lines in FIG. 6, thereby keeping the light beam from being incident on the first light receiving element 24. As described hereinabove, if the sheet 8 is skewed, there is a lag of the time at which the light beam incident on the first light receiving element 24 is intercepted behind the time at which the light beam incident on the second light receiving element 24*a* is intercepted. Let the time lag be denoted by $\Delta T$. The speed at which the sheets 8 are conveyed being substantially constant and the length l of the sheet 8 being known, it is possible to determine the magnitude S of the skew by detecting the time lag $\Delta T$. The length l of the sheets 8 may be detected each time copying operation is performed by sensing means, not shown, of any known type.

Figure 7:
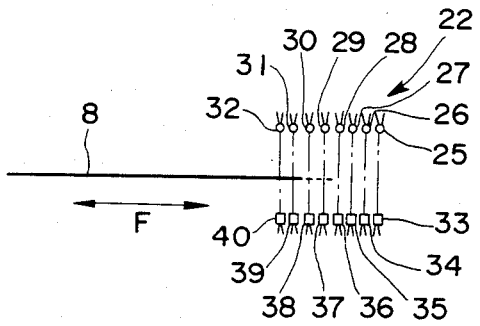
FIGS. 7 and 8 are views similar to FIGS. 5 and 6 respectively but showing the second detector of the first detecting means.
Figure 8:
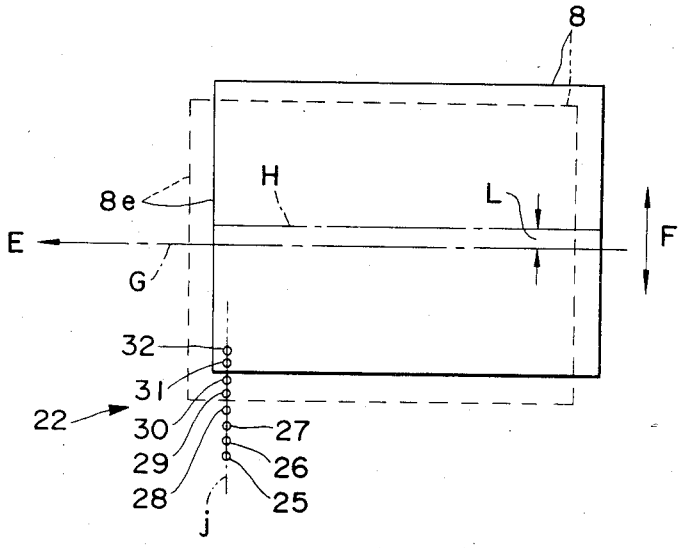

The second detector 22 which detects a displacement of the sheet 8 widthwise F thereof with its length remaining parallel to the center reference line G includes a plurality of photoelectric sensors composed of a plurality (eight in the embodiment shown) of light sources 25–32 and a plurality (eight in the embodiment shown) of light receiving elements 33–40 disposed in juxtaposed relation to the respective light sources which are located in a plane J perpendicular to the direction E in which the sheets 8 are conveyed, as shown in FIGS. 7 and 8. When the sheet 8 is not displaced widthwise F at all as indicated by broken lines in FIG. 8, light beam directed from a predetermined number of light source or four light sources 29, 30, 31 and 32 in this embodiment against a predetermined number of light receiving elements or four light receiving elements 37, 38, 39 and 40 in this embodiment juxtaposed against the respective light sources are intercepted, so that the light beams from these light sources are kept from being incident on the respective light receiving elements. However, light beams directed from other light sources 25, 26, 27 and 28 remain incident on the respective light receiving elements 33, 34, 35 and 36. If the sheet 8 is displaced widthwise by a magnitude L while its length remains parallel to the center reference line G as indicated by solid lines in FIG. 8, the number of light sources and light receiving elements having light beams intercepted by the sheet 8 will increase or decrease. In the embodiment shown in FIG. 8, the light beams directed from the light sources 31 and 32 against the light receiving elements 39 and 40 respectively are intercepted while the light beams directed from the light sources 25–30 against the light receiving elements 33–38 respectively remain incident thereon. Thus, it is possible to determine the magnitude L of the displacement of the sheet 8 by using as a reference the number of light receiving elements prevented from receiving light beams from the respective light sources when the sheet 8 shows no displacement and determining the difference between the reference number and the actual number of light receiving elements having light beams prevented from being incident thereon by the sheet 8.

The magnitudes L and S of the displacements of the sheet 8 can be determined as described hereinabove. If one or both of the magnitudes L and S rise above predetermined levels, the side wall actuating device is controlled such that the frequency of reciprocatory movements of the side walls 16 and 17 of the sheet aligning device 15 is increased, their speed is reduced or their stroke is increased.

Figure 9:
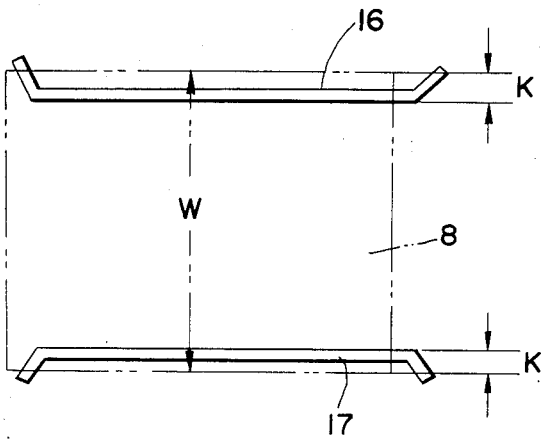
FIG. 9 is a view in explanation of the manner in which the side walls bite into a copy sheet.

By reducing the speed at which the side walls 16 and 17 is moved in reciprocatory movement, it is possible to positively achieve the sheet aligning effect, because application of an impact of high external force by the walls 16 and 17 on the sheet 8 can be avoided and the danger of the sheet 8 buckling or being repulsed by the walls 16 and 17 is prevented, even if the magnitude of the displacement is great. Also, by increasing the stroke of the side walls 16 and 17 in such a manner that, as shown in FIG. 9, the spacing interval between the side walls 16 17 is smaller than the width W of the sheet 8 having no external force exerted thereon when the spacing interval is minimized and that the side walls 16 and 17 bite into the sheet 8 by a magnitude K, it is possible to achieve the sheet aligning effect because the sheet 8 is strongly held down by the side walls 16 and 17. When the sheet 8 moves into the space between the side walls 16 and 17, they are disposed in inoperative positions. However, when the magnitudes L and S of the displacements of the sheet 8 are particularly great, the leading edge 8*e* of the sheet 8 might impinge on the side walls 16 and 17 even if they are disposed in the inoperative or standby positions indicated by solid lines in FIG. 2. Thus, by increasing the stroke of the reciprocatory movements of the side walls 16 and 17 in such a manner that the side walls 16 and 17 move to broken line positions shown in FIG. 2 which are spaced apart a greater distance from each other than the solid line positions it is possible to avoid the impinging of the sheet 8 on the side walls 16 and 17, thereby positively achieving the sheet aligning effect. The sheet aligning effect can be achieved by increasing the frequency with which the side walls 16 and 17 are moved in reciprocatory movement. More specifically, if the side walls 16 and 17 are moved in reciprocatory movement each time one sheet 8 or a small number of sheets 8 (two or three, for example) are fed into the tray 12 or if the side walls 16 and 17 are moved in a plurality of reciprocatory movements to cope with one sheet 8, it is possible to positively bring the sheet into alignment with the center reference line G even if the displacement of the sheet 8 is great in magnitude. It will be appreciated that when a large number of sheets are brought into alignment with each other, it is easier to handle a small number of sheets several times than to handle the large number of sheets at a time. The side wall actuating device can be advantageously controlled if the frequency, speed and stroke of the reciprocatory movements of the side walls 16 and 17 are adjusted in accordance with the magnitudes L and S of the displacement of the sheet 8 in such a manner that the frequency is increased, the speed is reduced and the stroke is increased when the displacement is great in magnitude.

In the embodiment shown and described, when the sheet 8 handled is of A4 size, the spacing $l_1$ between the side walls 16 and 17 in the inoperative positions shown in solid lines and the lateral sides 8*a* and 8*b* of the sheet 8, as shown in FIG. 2, is about 11 mm. When at least one of the magnitudes L and S of the displacements of the sheet 8 has a value of about 3 mm±0.5 mm, the side wall actuating device is controlled in such a manner that the side walls 16 and 17 are moved in one reciprocatory movement, the stroke of the reciprocatory movement is set at a value obtained by adding about 4 mm to the aforesaid magnitude K or about 15 mm, and the speed of the reciprocatory movement is set at a speed which would enable the distance of about 15 mm to be covered in about 0.13 second.

Thus, in the embodiment shown and described, the side wall actuating device is controlled in such a manner that when the predetermined value of the magnitudes L and S of the displacement of the sheet 8 is set at about 3 mm±0.5 mm, the side walls 16 and 17 are moved in reciprocatory movement a plurality of number of times, or the speed of the reciprocatory movements is reduced, or the stroke of the reciprocatory movements is increased, if at least one of the magnitudes L and S exceeds the predetermined value.

By controlling the movements of the side walls 16 and 17 as described hereinabove, it is possible to bring the sheets 8 into alignment with each other widthwise thereof to such a degree that further movement of the sheets 8 is not interfered with, even if the magnitudes L and S of the displacements of the sheets 8 are great.

Conversely, when the magnitudes L and S are smaller than the predetermined values, the movements of the side walls 16 and 17 are controlled such that the frequency of movements of the side walls 16 and 17 is reduced, the speed of movements is increased and the stroke of the movements is reduced. To reduce the stroke, one only has to set the inoperative positions of the side walls 16 and 17 at the solid line positions shown in FIG. 2 or set at positions nearer to the sheet 8, or one only has to reduce the magnitude of the side walls 16 and 17 biting into the sheet 8 as shown in FIG. 9 or eliminate the biting of the side walls 16 and 17 into the sheet 8. This does not necessarily reduce the effects achieved by the sheet aligning device 15 because the sheets 8 with a small magnitude L or S of displacements are essentially easy to align. Moreover, if the frequency of the reciprocatory movements of the side walls is reduced, their speed is increased and their stroke is reduced, then it is possible to reduce the time required for performing a sheet aligning operation and reduce the intervals at which the sheets 8 are successively fed to the photosensitive member 6. This advantage will be described in more detail.

Assume that the side walls are actuated to perform a sheet aligning operation when one sheet is fed to the photosensitive member 6, and that the next following sheet is fed to the photosensitive member 6 while the spacing interval between the side walls is still small. Then, there is the danger that the leading edge of the next following sheet would impinge on the side walls. To avoid this trouble, in the illustrated embodiment, the spacing interval between the side walls is greater than the width W of the sheet before the sheet enters the space defined between the side walls, and the next following sheet is allowed to enter the space between the side walls after the operation of bringing the preceding sheet into alignment with the center reference line G is finished. Thus, if a prolonged period of time is required for the side walls 16 and 17 to complete one reciprocatory movement, then it is necessary to increase the intervals at which the sheets are successively fed to the photosensitive member 6 to keep the leading edge of each successively fed sheet 8 from impinging on the side walls 16 and 17. However, in the embodiment of the illustrated construction, when the magnitudes L and S of the displacements of the sheet 8 are small, it is possible to reduce the period of time for the side walls 16 and 17 to move in one reciprocatory movement by increasing the speed of movements of the side walls and reducing their stroke. Thus, the trouble of the leading edge of the sheet impinging on the side walls can be avoided even if the intervals at which the sheets are fed is rather reduced, as contrasted with the operation in which it takes a prolonged period of time for the side walls to move in reciprocatory movement to cope with sheets having large magnitudes L and S of displacements. When the magnitudes L and S are small, the frequency of reciprocatory movements of the side walls 16 and 17 may be reduced in such a manner that a sheet aligning operation is performed each time about ten (10) sheets are fed to the tray 12, for example. This would make it possible to increase as much as necessary the interval at which the sheet following the sheet being aligned by the side walls 16 and 17 while minimizing the intervals at which the following sheets are fed. By reducing the intervals at which the sheets are fed, it is possible to reduce the time necessary for a predetermined number of sheets to be processed or increase the copying speed.

In the sheet aligning device 15 of the aforesaid construction, the side wall actuating device is controlled to cause the side walls 16 and 17 operate differently in accordance with the magnitudes L and S of the displacements of the sheets 8, so as to set the intervals at which the sheets 8 are fed successively according to the magnitudes L and S. More specifically, the intervals are increased when the magnitudes L and S are great to enable alignment of sheets to be positively obtained, and reduced when the intervals are small to increase the speed at which copying is performed. Thus, it is necessary to alter the intervals each time a copying operation is performed. The end can be attained by controlling in accordance with the output of the detecting means 20 the timing with which the light source 4 shown in FIG. 1 is moved rightwardly from the illustrated position. More specifically, when it is found by the detecting means 20 that the magnitudes L and S are great and it is necessary to increase the intervals, control is effected such that the time at which the light source 4 begins to move is delayed by the output of the detecting means 20 so as to match the timing with which the sheets 8 are fed to the photosensitive member 6 to the timing with which the movement of the light source 4 is begun. Conversely, when it is desired to reduce the intervals, control is effected such that the time at which the light source 4 begins to move is hastened and the sheets 8 are fed to the photosensitive member 6 with a timing matching the timing with which the light source 4 begins to move.

However, if the time at which the light source 4 begins to move is controlled as aforesaid while the detecting means 20 is located in the illustrated position in FIG. 1, the problem described hereinafter might be raised That is, after the copying operation is started, the magnitudes L and S are not determined until the first sheet 8 reaches the detecting means 20. However, when the first sheet 8 reaches the detecting means 20, the light source 4 has already completed at least one reciprocatory movement. Thus, it would be impossible to control the timing with which the movement of the light source 4 is initiated in accordance with the magnitudes L and S.

When sheets 8 of a certain type are placed in the main sheet feeding device 7 prior to the initiation of a copying operation, the size, thickness and quality of the sheets 8 are known and substantially constant. Thus, the magnitudes L and S of the displacements of the sheets 8 are usually substantially constant when they are successively fed and pass through the detecting means 20. In view of the foregoing, control may be effected as follows. Until the first sheet 8 reaches the detecting means 20 and the magnitude L or S is detected, the intervals are increased to allow the sheets 8 to be readily aligned with each other no matter how large the magnitude may be. The frequency with which the side walls 16 and 17 are moved in reciprocatory movement is increased, the stroke of their movements is increased and the speed of their movements is reduced to positively bring the sheets 8 into alignment with each other. After the magnitude of a displacement of the first sheet 8 is detected, the timing with which the movement of the light source 4 is initiated is controlled in accordance with the magnitude of the displacement or the output of the detecting means, to set the intervals at a suitable level and control the frequency, speed and stroke of the reciprocately movements of the side walls 16 and 17 accordingly. By effecting control as described hereinabove, it is possible, although a period of time longer than is necessary might be required for handling the first sheet and a few sheets following the first sheet, to bring the rest of the sheets into alignment with each other in a suitable period of time. Meanwhile, the number of sheets on which toner images are formed before the magnitude of a displacement of the first sheet is detected is usually very small, and a small number of sheets can be usually brought into alignment with each other with ease. Thus, no great trouble occurs by making an arrangement whereby the intervals at which sheets are fed are rather reduced before the magnitude of the displacement of the first sheet is detected in performing sheet aligning, and the timing with which the movement of the light source 4 is initiated is only controlled after the magnitude of the displacement of a sheet is detected.

By setting the position of the detecting means in such a manner that the magnitudes of the displacement of a sheet can be detected before the sheet reaches the photosensitive member 6 before being fed from the main sheet feeding device 7, it is possible to control the timing with which the movement of the light source 4 is initiated to enable all the sheets to be fed at suitable intervals. However, if the detecting means is located in the aforesaid position, the sensing means would be spaced apart from the tray 12 a great distance. This would make it necessary to determine the magnitude of the displacement of a sheet by taking into consideration the magnitude of a displacement of the sheet that would occur between the detecting means and the tray 12.

The actuating device for moving the side walls 16 and 17 in reciprocatory movement comprises, as shown in FIGS. 2, 3 and 12, guide rods 41 extending widthwise F through a lower portion of the tray 12, on which the side walls 16 and 17 are fitted for sliding movement widthwise of the sheet 8. One side wall 16 is secured in a position 16*b* to one run 42*a* of an endless chain 42 trained over a drive sprocket wheel 43 and a follower sprocket wheel 44, and the other side wall 17 is secured in a position 17*b* to an opposite run 42*b* of the endless chain 42. The drive sprocket wheel 43 is driven for rotation by a steppling motor, not shown, which rotates in accordance with the number of inputted pulses, to move the runs 42*a* and 42*b* of the endless chain 42 in opposite directions to thereby move the side walls 16 and 17 toward and away from each other. The invention is not limited to the stepping motor, and other known motor or drive means may be used. The actuation of the side walls 16 and 17 is controlled as described hereinabove. The distance covered by the movement of the side walls to the phantom line postions shown in FIG. 2 may vary depending on the width W of the sheets. To cope with this situation, control may be effected such that a central processing unit is provided to regulate the rotation of the stepping motor or clutch or speed change gearing located between the motor and side walls is actuated. The timing with which the movement of the light source 4 is initiated may be controlled readily by using a central processing unit.

The basic constructional form of the sheet aligning device according to the invention has been described by referring to the accompanying drawings. However, many changes and modifications may be made therein. For example, the actuating device for moving the side walls may comprise a rope and pulleys, in place of the endless chain and the sprocket wheels. Alternatively, a feed screw driven for rotation and a nut threadably engaging the feed screw and moving therewith as a unit may be used. Other known means may, of course, be used. In place of moving the opposite side walls in reciprocatory movement and bringing the sheets into alignment with the center reference line G, one side wall 16 shown in FIG. 2 may be made movable but the other side wall 17 may be made immovable, thereby allowing only the one side wall 16 to move in reciprocatory movement when a sheet aligning operation is performed. If only one side wall is moved, it is possible to align the sheets with each other by using the position of the immovable side wall as a reference (one side reference).

Figure 10:
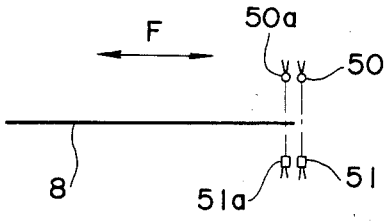
FIGS. 10 and 11 are views corresponding to FIGS. 5 and 6 respectively but showing the second detecting means.
Figure 11:
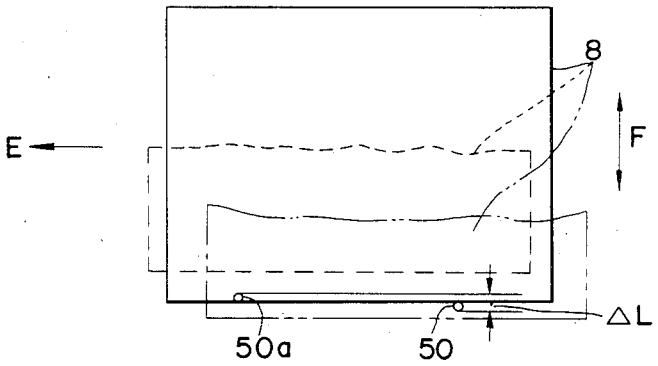

The invention is not limited to the detecting means of the type described. For example, means for detecting the magnitudes of the displacements of sheets may comprise a photoelectric sensor including a light source 50 and a light receiving element 51 located in spaced juxtaposed relation on opposite sides of the sheet 8 and another photoelectric sensor including a light source 50*a* and a light receiving element 51 a located in spaced juxtaposed relation on opposite sides of the sheet 8 as shown in FIG. 10. The two photoelectric sensors 50, 51 and 50*a*, 51*a* are spaced apart a small distance ΔL widthwise F of the sheet 8, as shown in FIG. 11. When the sheet 8 is not displaced withdthwise F as indicated by solid lines, a light beam directed from the light source 50*a* against the light receiving element 51*a* is intercepted by the sheet 8 while a light beam directed from the light source 50 against the light receiving element 51 is incident thereon. When the displacement of the sheet 8 widthwise F thereof is great in magnitude as indicated by phantom lines in FIG. 11, the light beams directed from the light sources 50 and 50*a* against the light receiving elements 51 and 51*a* respectively are both intercepted by the sheet 8 or not intercepted thereby entirely. This indicates that the copy sheet 8 is displaced widthwise F although it remains in alignment with the center reference line G. By setting the magnitude of ΔL at a suitable level, it is possible to alter the reference for determining whether or not the sheet remains parallel with other sheets although it is displaced widthwise F.

By using the detecting means shown in FIGS. 7 and 8, it is possible to determine the slanting or skew of a sheet 8. More specifically, when the sheet 8 is skewed, the time at which the light beam of the light source of one photoelectric sensor incident on the light receiving element thereof is intercepted by the sheet will show a lag behind the time at which the light beam of the light source of another photoelectric sensor incident on the light receiving element thereof is intercepted in the same manner as described by referring to the detecting means shown in FIGS. 5 and 6. Thus, by detecting the time lag, it is possible to determine the skew of the sheet 8. If the skew of the sheet 8 is detected while the displacement of the sheet 8 widthwise F thereof although remaining in alignment with the center reference line G is also detected, then it is possible to detect both the skew and the displacement of the sheet 8 widthwise F thereof while remaining in alignment with the center reference line G by using only the detecting means shown in FIGS. 7 and 8.

When the sheets 8 are conveyed in accordance with the center reference and brought into alignment with the center reference line G at the tray 12, as is the case with the embodiment shown in FIG. 2, it might be impossible to detect displacements of sheets 8 by the detecting means shown in FIGS. 7 and 8 and 10 and 11, when the sheets 8 show a difference in width W. Displacements of sheets 8 can be detected without any difficulty if the sensing means is shifted widthwise F in conformity with the width W. When sheets 8 are conveyed in accordance with one-side reference and aligned according to one-side reference, it is possible to detect the magnitudes of displacements even if the detecting means remains immovable. The detecting means shown in FIGS. 5 and 6 is capable of detecting the magnitudes of displacements without moving its position, regardless of whether the reference is center reference or one-side reference.

The same results can be achieved by using detecting means relying on other means than the photoelectric sensors.

In the embodiment shown and described, both the skewing and displacing of sheets 8 widthwise thereof while remaining in alignment with the reference line are detected. However, either the skewing or the displacement of sheets while remaining parallel to the reference line may be detected by the detecting means and at least one of the frequency, speed and stroke of the reciprocatory movements of the side walls 16 and 17 may be controlled in accordance with the output of the detecting means, to accomplish the objects of the invention.

Although it is not directly related to the displacement of a sheet, the length of the sheet aligned with the direction in which the sheet is conveyed is an important factor concerned in the determination of the intervals at which a plurality of sheets are successively fed to the photosensitive member 6. The invention will be described by referring to the embodiment shown and described hereinabove with regard to the length of sheets.

Figure 13:
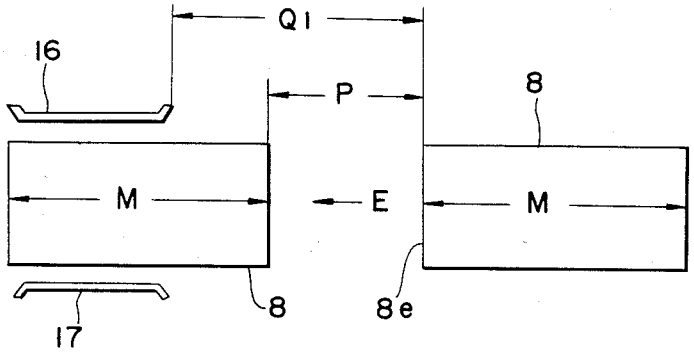
FIGS. 13 and 14 are plan views in explanation of the relation between the length of a copy sheet and the side walls.
Figure 14:
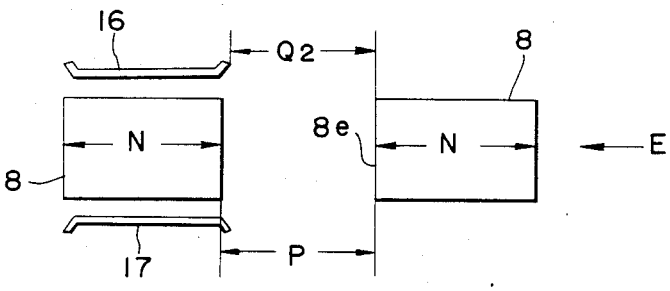

Referring to FIGS. 13 and 14, assume that the sheets 8 are fed successively at intervals P to a space defined between the side walls 16 and 17. The intervals P are set in such a manner that the leading edge 8*e* of the next following sheet 8 (the sheet on the right side in the figure) does not impinge on the side walls 16 and 17. When the length M of the sheets 8 aligned with the direction E in which they are fed is great as shown in FIG. 13, the distance $Q_1$ between right ends of the side walls 16 and 17 and the leading edge 8*e* of the next following sheet 8 is greater, as the preceding sheet 8 is disposed in the space between the side walls 16 and 17, than the distance $Q_2$ between the right ends of the walls 16 and 17 and the leading edge 8*e* of the next following sheet 8 when the length N of the sheets 8 is small as shown in FIG. 14. Thus, the speed at which the sheets 8 are conveyed being constant, the greater the length of the sheets 8, the longer is the time that elapses after the preceding sheet 8 has reached the space between the side walls 16 and 17 until the next following sheet 8 reaches the right ends of the side walls 16 and 17. Stated differently, if the sheets 8 have a great length, it is possible for the side walls 16 and 17 to take a longer time to move in reciprocatory movement between inoperative and operative positions than if they have a short length, thereby making it possible to increase the frequency of the reciprocatory movements and increase their stroke while reducing their speed. It has been described hereinabove that when the magnitudes L and S of the displacements of the sheets 8 are great, the frequency of the reciprocatory movements of the side walls 16 and 17 is increased and the time required for handling each sheet 8 is prolonged. In this case, when the sheets 8 have a great length, it is possible to avoid the danger of the leading edge of the next following sheet 8 impinging on the side walls 16 and 17 can be avoided without requiring to increase the intervals at which the sheets 8 are fed to the photosensitive member 6. Thus, the frequency, stroke and speed of the reciprocatory movements of the side walls 16 and 17 are preferably controlled by detecting the length of the sheets 8 by known detecting means or setting the apparatus to the specific length by depressing a key on the operation panel of the main body of the apparatus in addition to detecting the displacements of the sheets 8 widthwise thereof.

Usually, some sheets are easy to align and others are difficult to attain the end of bringing them into alignment with each other. This is attributed to the nature of the sheets or the rigidity, thickness, surface smoothness, weight and size of the materials of the sheets and environmental factors including temperature and humidity. The sheets listed hereinafter are hard to align.

1. Nature of Sheets

Sheets of large width, large thickness, low rigidity, light weight and high frictional dragging on each other.

2. Environmental Factors

High humidity (the sheets absorb moisture and become lower in rigidity), and high temperature (although the results achieved may vary depending on the quality of material, the sheets become harder to align when ambient temperature rises in most cases).

3. Other Factors

When the fixing device relies on thermal fixing, the sheets become harder to align when the heat used for thermal fixing is high in temperature because of the increased tendency of the sheets to curl.

The sheets which do not belong to the aforesaid groups are easy to align.

In the prior art, the aforesaid factors tending to influence the ease with which the sheets are aligned have not been taken into consideration in controlling the actuating device for moving the side walls 16 and 17 by changing the frequency, stroke and speed of the reciprocatory movements of the side walls 16 and 17. This has often resulted in being unable to achieve unsatisfactory results in aligning the sheets 8 or taking more time than is necessary to perform sheet aligning.

According to the invention, these disadvantages of the prior art are obviated by taking at least one of the aforesaid factors into consideration and moving the side walls 16 and 17 with a frequency suiting the particular condition, at a speed suiting the particular condition or at a stroke suiting the particular condition, so that satisfactory results can be achieved in bringing the sheets 8 into alignments with each other or the waste of time can be avoided in performing a sheet aligning operation.

More specifically, in the embodiment shown and described hereinabove, the actuating device for moving the side walls 16 and 17 is controlled, when at least one of the aforesaid factors concerned in making it difficult to align the sheets 8 exists, in such a manner that the frequency of the reciprocatory movements of the side walls 16 and 17 is increased, their speed is reduced, or their stroke is increased.

Conversely, when the sheets 8 are of the nature or under the conditions making it easier to bring them into alignment, the frequency of the reciprocatory movements of the side walls 16 and 17 is reduced, their speed is increased or their stroke is reduced.

Figure 16:
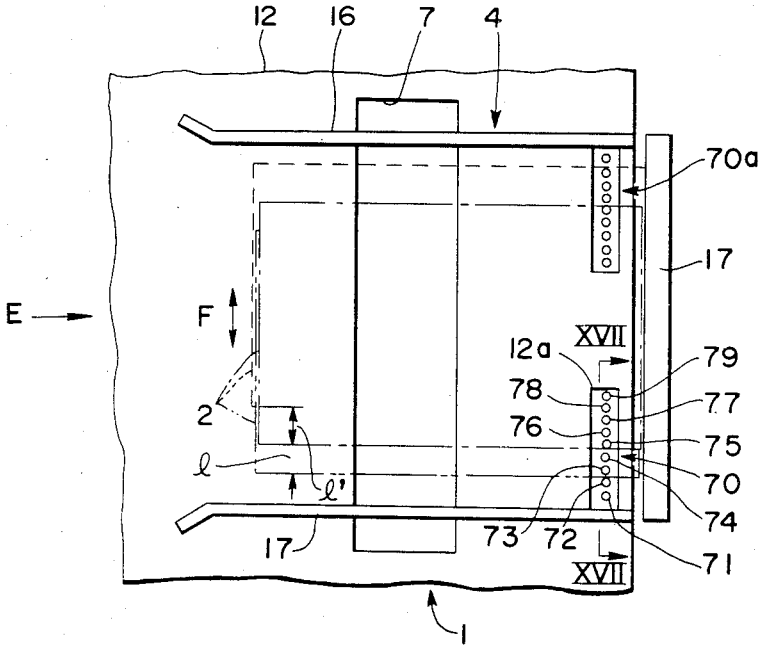
FIG. 16 is a plan view similar to FIG. 15 but showing the condition in which the copy sheets are misaligned.
Figure 17:
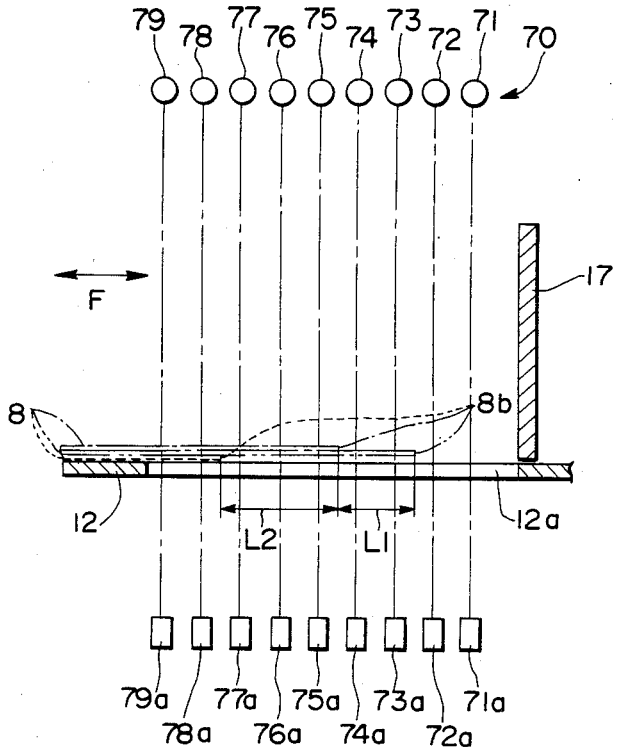
FIG. 17 is a sectional view of the third detecting means.

As described hereinabove, the sheets 8 are brought into alignment with each other by the sheet aligning device 15. When the sheets 8 have a large volume of static buildup, are damaged, are greatly curled or are low in rigidity, the precision with which they are aligned might be reduced due to the lateral sides 8*a* and 8*b* of each sheet 8 being pressed back by the side walls 16 and 17, respectively. In FIGS. 16 and 17, a sheet 8 disposed in a predetermined postion, a sheet 8 of low aligning precision which is biased toward the side wall 17 and a sheet 8 of low aligning precision which is biased toward the side wall 16 are designated by dot-and-dash lines, two-dots between two-dashed lines and broken lines, respectively. If the copy sheets 8 which are not disposed in the predetermined postion on the tray 12 are fed to the photosensitive member 6, it would be impossible to bring them into index with a predetermined zone on the photosensitive member 6 in the printing station, so that a developed image would be formed in a position on the sheet which is displaced from the predetermined position. Also, a jamming of the sheets might occur when they are fed from the irregular positions on the tray 12.

Figure 15:
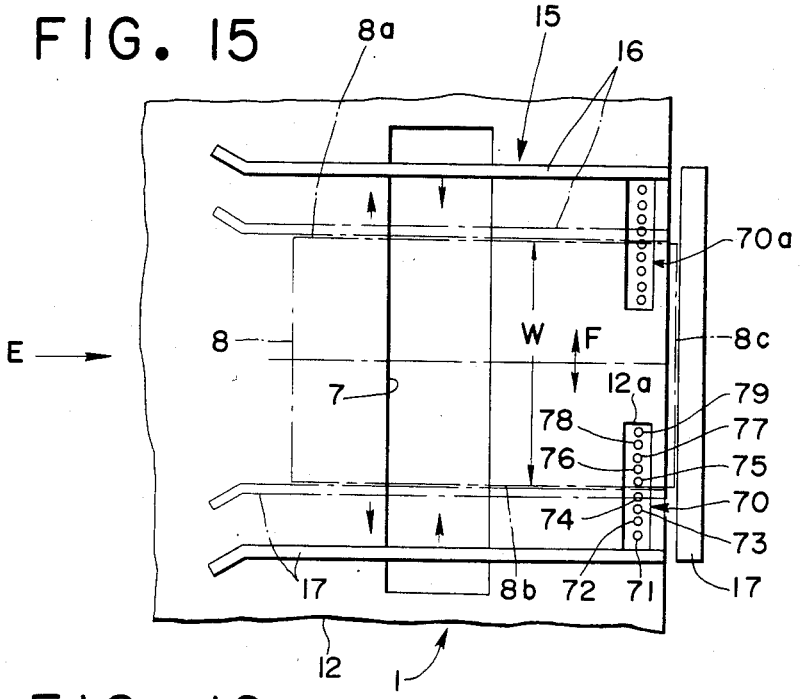
FIG. 15 is a plan view similar to FIG. 2 but showing the third detecting means, with a sheet aligning operation being performed while the guide rods are removed.

In the invention, the sheet aligning device 15 further comprises third detecting means 70 shown in FIGS. 15–17 which checks on the sheet 8 after being subjected to the sheet aligning operation by the side walls 16 and 17. The detecting means 70 comprises a plurality (nine in this embodiment) of light sources 71–79 arranged widthwise F of the sheet 8 in positions above the tray 12, and a plurality (nine in this embodiment) of light receiving elements 71*a*–79*a* arranged widthwise F of the sheet 8 in positions below the tray 12, so that each light source and light receiving element pair constitutes a photoelectric sensor. As shown in FIG. 17, light beams from the light sources 71–79 are incident on the respective light receiving elements 71*a*–79*a* as indicated by phantom lines through a light opening 12*a* formed in the tray 12.

When the sheet 8 aligned by the side walls 16 and 17 is disposed in the predetermined position as indicated by dash-and-dot lines in FIGS. 16 and 17, the light beams directed from the predetermined number of light sources selected in accordance with the width W of the sheet 8 or five light sources 75–79 in the embodiment shown against the respective light receiving elements 75*a*–79*a* are intercepted by the sheet 8 while the light beams directed from other light sources or 71–74 against the respective light receiving elements 71*a*–74*a* are allowed to be incident thereon. When the sheet 8 handled by the side walls 16 and 17 is not disposed in the predetermined position on the tray 12, the number of light sources whose light beams are intercepted by the sheet 8 increases or decreases. For example, when the sheet 8 handled by the side walls 16 and 17 is disposed such that its lateral side 8*b* is disposed outwardly of the lateral side 8*b* in the predetermined position by a distance $L_1$ as indicated by two-dots between two-dashed lines in FIGS. 16 and 17, the seven light beams directed from the light sources 73–79 against the respective light receiving elements 73*a*–79*a* are intercepted by the sheet 8. When the sheet 8 handled by the side walls 16 and 17 is disposed in the position indicated by the broken lines in FIGS. 16 and 17 in which the lateral side 8*b* is disposed inwardly of the predetermined position of the lateral side 8*b* by a distance $L_2$ as indicated by broken lines, the light beams directed from the two light sources 78 and 79 against the respective light receiving elements 78*a* and 79*a* are intercepted by the sheet 8. Thus it will be possible to determine how the sheets 8 have been handled by the side walls 16 and 17 by counting the number of light receiving elements on which no light beams are incident and comparing the number obtained with the number of light receiving elements on which no light beams are incident when the sheet 8 is disposed in the predetermined position which serves as a reference number.

Detecting means 70*a* similar to the detecting means 70 described by referring to FIGS. 16 and 17 may be mounted in the vicinity of the lateral side 8*a* of the sheet 8 as shown in FIGS. 15 and 16.

The results achieved by the aligning device 15 can be checked as described hereinabove. When the sheets 8 handled by the side walls have not been properly aligned, the following steps may be taken:

(a) When the sheets 8 are misaligned, the magnitudes $L_1$ and $L_2$ of the displacements of the sheets may be indicated by an indicator of the main body of the copying apparatus by digital display in accordance with the output of the third detecting means and at the same time transmitted to the operator; and (b) When the magnitudes $L_1$ and $L_2$ of the displacements have exceeded the predetermined levels, indication may be given by means of a warning device (lamp, buzzer, etc.) mounted in the main body of the copying apparatus and at the same time the information may be transmitted to the operator.

The indication may be given each time misalignment occurs during the period of time the sheets 8 are successively conveyed to the tray 12 or at a time after a predetermined number of sheets 8 have been stacked on the tray 12. In the latter case, the results achieved by the sheet aligning device 15 may be checked only after the predetermined number of sheets 8 have been stacked on the tray 12. When the indication is given while the sheets are being conveyed to the tray 12, the operator may render the copying apparatus inoperative and restart the copying operation by depressing the print key after manually bringing the sheets 8 into alignment. Alternatively, the operation of the copying apparatus may be automatically interrupted by the output of the detecting means. When the indication is given after all the sheets 8 have been stacked on the tray 12, the sheets can be brought into alignment after completion of the stacking of all the sheets 8 on the tray 12. The condition of misalignment of the sheets 8 that can be tolerated may usually differ from one operator to another. When a slight displacement of an image formed on a sheet is tolerated, no problem is raised even if the sheets on the tray 12 are somewhat out of alignment. However, when the standards are quite severe with regard to the position of the image on the sheet, the sheets should be strictly brought into alignment on the tray 12. Thus, when the condition of the sheets 8 handled by the side walls is indicated, the copying operation may be continued without interruption if the operator is satisfied with the condition, and steps may be taken for repeating the sheet aligning operation if he is dissatisfied with the condition. If the indication is given by digital display as set forth in paragraph (a), it is possible for the operator to positively check the Magnitudes $L_1$ and $L_2$, making it easy for him to make up his mind as to whether the sheet aligning operation should be performed again.

In place of taking the steps described in paragraphs (a) and (b) or simultaneously as they are taken, the actuating means for the side walls 16 and 17 or the stepping motor in this embodiment may be controlled to realign the sheets 8 as by increasing the frequency of the reciprocatory movements of the side walls, when the condition of the sheets 8 handled by the side walls 16 and 17 is not satisfactory and the magnitudes $L_1$ and $L_2$ has exceeded the predetermined levels. In this case, the sheet realigning operation may be performed by increasing the frequency of reciprocatory movements of the side walls 16 and 17, either by interrupting or without interrupting the copying operation, during the time the sheets 8 are successively conveyed to the tray 12. Alternatively, the side walls 16 and 17 may be additionally moved once or a few times to realign the sheets 8 after a predetermined number of sheets 8 have been stacked on the tray 12. Also, the effects of aligning the sheets 8 may be increased by decreasing the speed or stroke of the reciprocatory movements of the side walls 16 and 17, so as to thereby realign the sheets 8 with a high degree of efficiency.

The operation of realigning the sheets 8 either manually or by means of the side walls 16 and 17 while the conveying of the sheets 8 to the tray 12 is interrupted may be advantageously performed because a loss of time can be avoided. For example, realigning of the sheets may be advantageously performed when steps are being taken to eliminate a sheet jamming occurring in the path of travel of the sheets in the copying apparatus, when a so-called cut-in copying operation is performed in which one-side copying is performed during the time both-sides copying is being performed or by taking advantage of the time during which one document to be copied is replaced by another document.

Figure 18:
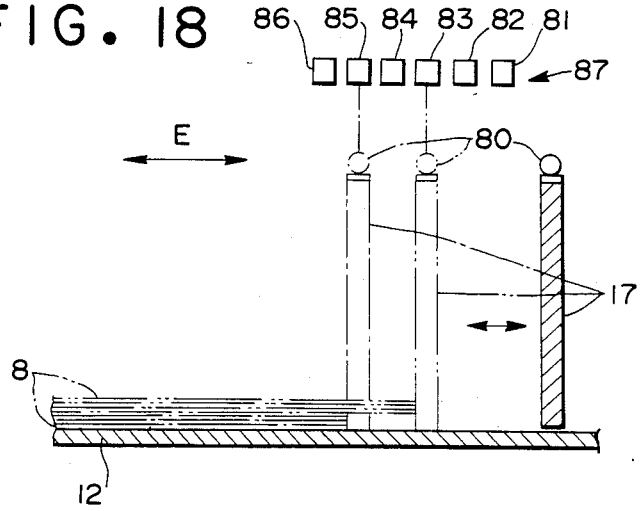
FIG. 18 is a sectional view of a modification of the third detecting means shown in FIG. 17.

Other detection means than those shown in FIGS. 15–17 may be used for checking the results achieved by the sheet aligning device 15. For example, when the sheets 8 on the tray 12 are not properly aligned, this may apply a load to the side walls 16 and 17 and make it impossible for them to move to the phantom line positions shown in FIG. 15. This fact may be taken advantage of and the results achieved by the sheet aligning device 15 may be determined by detecting the positions in which the side walls 16 and 17 have become closest to each other or the distance between these positions. FIG. 18 shows one example of such means. Assume that the side wall 17 becomes closest to the side wall 16, not shown, when the former moves to a one-dot between two-dashes position as the sheets 8 are aligned in a predetermined position as indicated by one-dot between two dashed lines. In this case, if the sheets 8 are misaligned as indicated by two-dots between two-dashed lines, a final position in which the side wall 17 becomes closest to the side wall 16 is as indicated by two-dots between two-dashed lines. The detecting means 87 shown in FIG. 18 comprises a light source 80 supported on the side wall 17 for movement as a unit therewith, and a plurality of light receiving elements 81–86 located above the tray 12 and arranged widthwise F of the sheets 8. As the side wall 17 moves into the final position designated by one-dot between two-dashed lines, a light beam emanating from the light source 80 is incident on the light receiving element 85. If the final position of the side wall 17 is as indicated by two-dots between two-dashed lines, the light beam from the light source 80 is incident on the light receiving element 83. Thus, by using the incidence of the light beam from the light source 80 on the light receiving element 85 when the side wall 17 reaches the final position as a reference, it is possible to check the results achieved by the sheet aligning device 15 by finding out on which light receiving element the light beam from the light source 80 is actually incident, to thereby learn how the sheets 8 have been handled.

Figure 19:
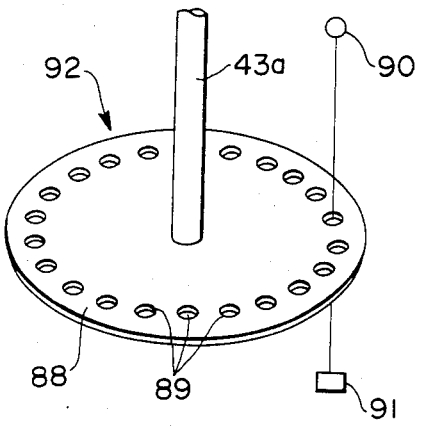
FIG. 19 is a perspective view of another modification of the third detecting means shown in FIG. 17.

The stepping motor for driving the side walls 16 and 17 has inputted thereto a predetermined number of pulses which may vary depending on the width of the sheets 8 and rotates through an angle determined by the inputted number of pulses. However, when the sheets 8 are misaligned and the side wall 17 is unable to move to the final position indicated by one-dot between two-dashed lines in FIGS. 15–18, the angle through which the drive sprocket wheel 43 (FIG. 2) rotates will become smaller than the aforesaid angle through which the steping motor rotates. By taking advantage of this fact, detecting means 92 shown schematically in FIG. 19 is provided which comprises a disc 88 secured to a rotary shaft 43*a* supporting the drive sprocket wheel 43 (FIG. 2) for rotation, a multiplicity of apertures 89 formed equidistantly in an outer peripheral portion of the disc 88, and an optical sensor including a light source 90 and a light receiving element 91 located in spaced juxtaposed relation. The parts of the detecting means 92 are positioned such that a light beam emanating from the light source 90 will pass through one of the apertures 89 before being incident on the light receiving element 91. Thus, as the disc 88 rotates and when each of the apertures 89 is interposed between the light source 90 and light receiving element 91, the light beam from the light source 90 is incident on the light receiving element 91. Therefore, the number of times the light beam is incident on the light receiving element 91 indicates the angle of rotation of the disc 88 or the drive sprocket wheel 43. This indicates the distance covered by the movement of the side wall 17.

Assume that the number of pulses inputted to the stepping motor for driving the side walls 16 and 17 from their inoperative positions indicated by solid lines to the predetermined final positions (when no misalignment occurs) designated by one-dot between two-dashed lines in FIG. 15 is n and that at this time the rotation of the disc 88 brings the light beam from the light surce 90 into incident on the light receiving element 91 through the apertures 89 which are $n_1$ in number. If the sheets 8 are misaligned and the final position of the side wall 17 is one indicated by two-dots between two-dashed lines in FIG. 18, for example, the angle of rotation of the disc 88 will be reduced, and the number of apertures 89 through which the light beam from the light source 90 passes will become $n_2$, for example. Thus, by comparing the numbers $n_2$ and $n_1$ with each other, it is possible to determine the results achieved by the sheet aligning device 15.

Figure 20:
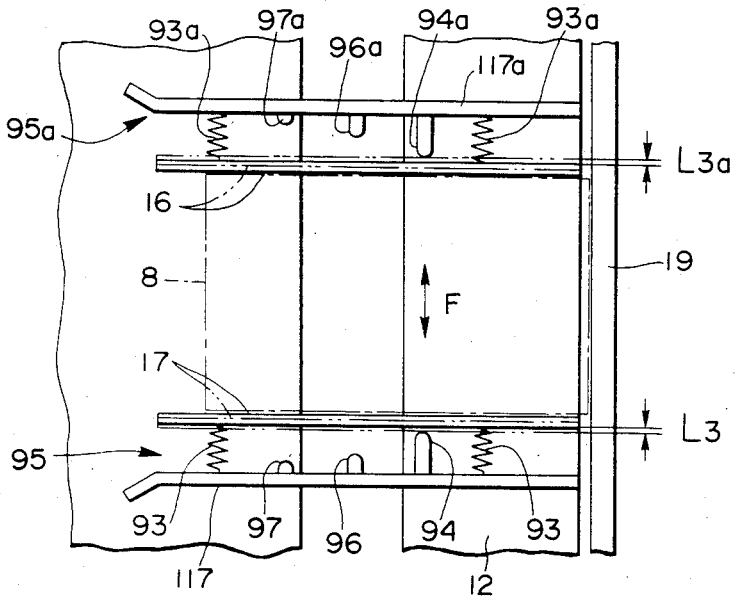
FIG. 20 is a plan view of the sheet aligning device comprising another embodiment in which compression spring and support plates are used to support the side walls for moving same to align the sheets.

FIG. 20 shows another embodiment in which the side wall 17 is supported by a support plate 117 through compression springs 93, and the support plate 117 is slidably supported by guide rods and driven by an endless chain in the same manner as described by referring to the side wall 17 shown in FIG. 2. A switch 94 actuated by the side wall 17 is mounted on the support plate 117 and cooperates with the compression springs 93, side wall 17 and support plate 117 to constitute detecting means 95. When the sheets 8 are stacked in the predetermined position in alignment with each other, the side wall 17 and support plate 117 move to final positions indicated by solid lines in FIG. 20. Assume that the sheets 8 are misaligned and their lateral sides project toward one side (downwardly in FIG. 20). Then, the support plate 117 is moved to the final position indicated by the solid lines, but the side wall 17 moves toward the side wall 17 a distance $L_3$ as indicated by two-dots between two-dashed lines, because the side wall 17 is depressed by the sheets 8 and the compression springs 94 are compressed. This causes the switch 94 to be depressed by the side wall 17 and turned on, thereby indicating that the sheets 8 are misaligned. In addition to the switch 94, a suitable number of switches 96 and 97, for example, may be provided and operated in such a manner that the second switch 96 is turned on as the side wall 17 further moves close to the side plate 117 and the third switch 97 is turned on as the side wall 17 moves closer to the side plate 117. This enables the displacements of the sheets 8 widthwise F thereof to be indicated step by step.

Detecting means similar to the detecting means shown and described hereinabove by referring to the side wall 17 is provided to the side wall 16 to detect the displacements of the sheets 8 upwardly in FIG. 20. The detecting means 95*a* is similar in construction and function to the detecting means 95, so that the parts of the detecting means 95*a* will be designated by reference characters designating the corresponding parts of the detecting means 95 but having subscripts a added thereto and their detailed description will be omitted.

The steps to be taken when the detecting means shown in FIGS. 18–20 is used to check the results achieved by the sheet aligning device 15 and the condition of the sheets 8 handled by the side walls 16 and 17 has been found, or indication of the condition of misaligned sheets and realizing the sheets are performed in the same manner as described by referring the detecting means shown in FIGS. 15–17.

Figure 21:
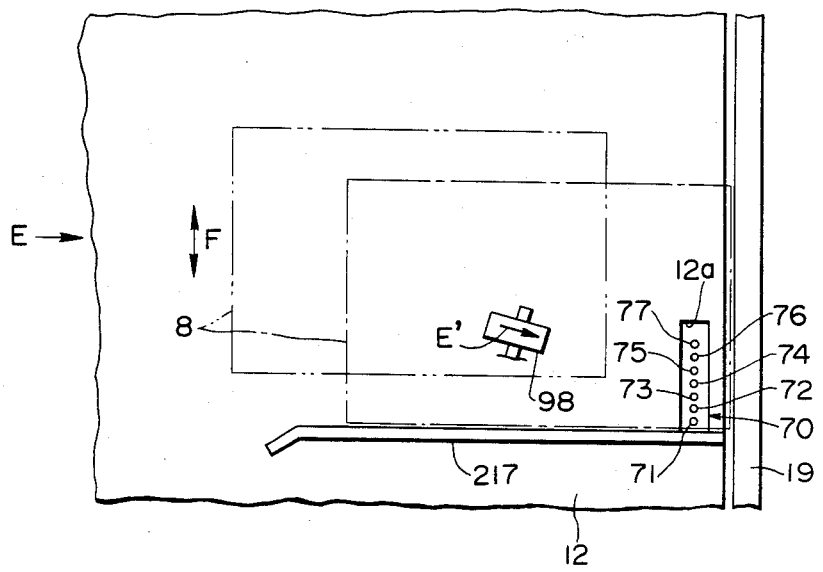
FIG. 21 is a plan view of the sheet aligning device comprising still another embodiment in which a slanting roller is used for exerting on a sheet a force oriented in a direction skewed with respect to the direction in which the sheet is fed.

The invention has been described as being incorporated in a sheet aligning device comprising a pair of side walls 16 and 17 which are moved toward and away from each other in reciprocatory movement to bring sheets 8 into alignment with the center reference line G. It is to be understood, however, that the invention is not limited to the specific constructional form and that many changes and modifications may be made therein. For example, one of the two side walls may be firmly fixed and the other side wall may be moved in reciprocatory movement to bring the sheets into alignment (one-side reference). As shown in FIG. 21, a slanting roller 98 exerting on the sheet 8 indicated by two-dots between two-dashed line in FIG. 21 which is conveyed to the tray in the direction E a force oriented in a direction (indicated by an arrow E') skewed with respect to the direction E may be provided to force the sheet 8 against the fixed side wall 217, so as to move the sheet 8 to a one-dot between two-dashes position in which the sheet 8 is aligned widthwise F thereof. This sheet aligning device may be provided with detecting means 70 similar to the detecting means described by referring to FIG. 17 which comprises the light sources 71–79 and the light receiving elements **71*a*–79*a*** associated therewith.

In a copying apparatus, a printer or peripheral equipment thereof which is provided with a sheet aligning device, it is necessary to monitor the sheets delivered to the sheet aligning device for the purpose of checking whether or not the sheets successively conveyed to the sheet aligning device are positively delivered or counting the number of sheets delivered thereto.

A sheet aligning device capable of monitoring the sheets delivered thereto will now be described.

Figure 22:
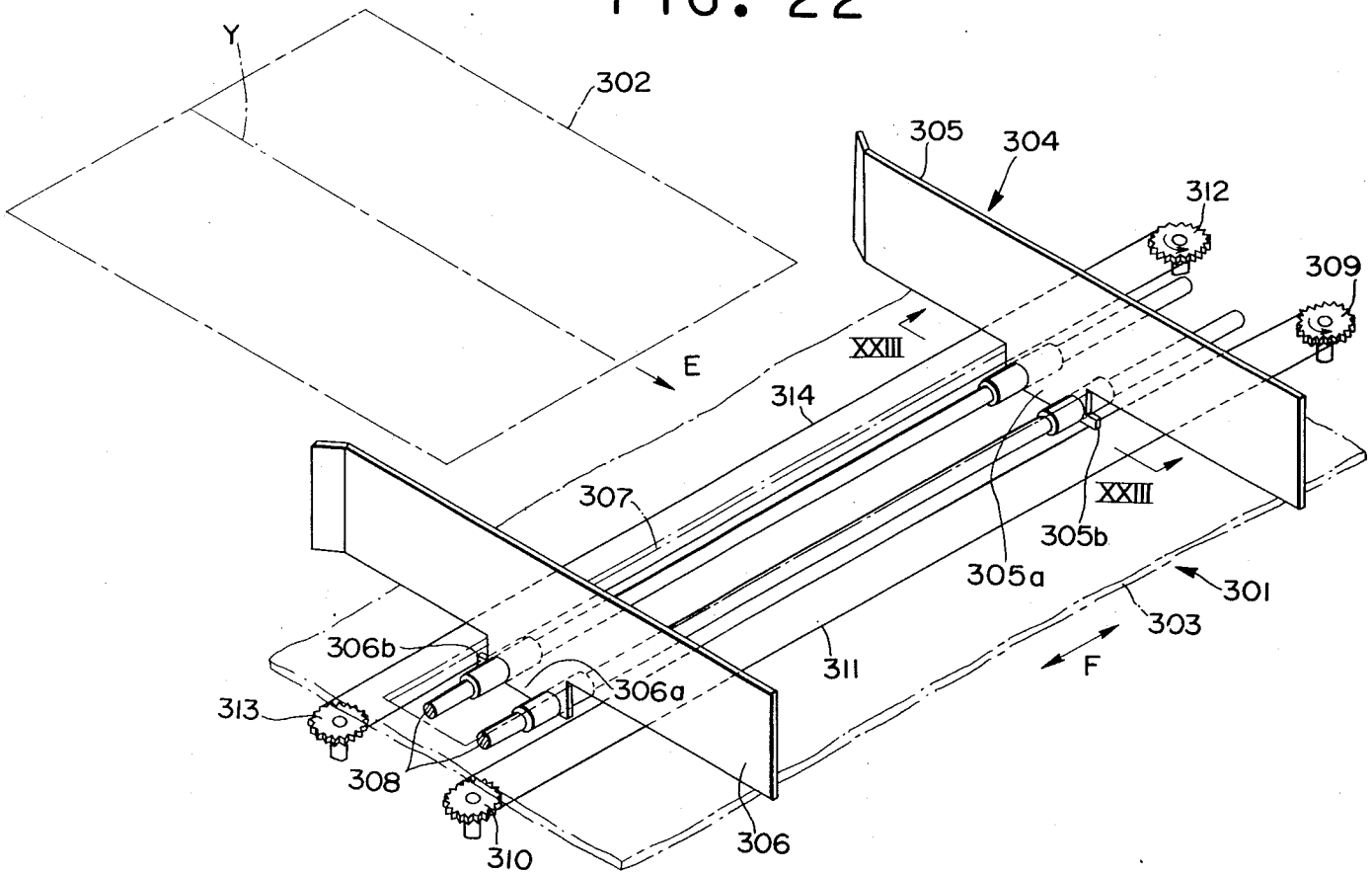
FIG. 22 is a fragmentary perspective view of the intermediate sheet feeding device cooperating with the sheet aligning device according to the invention, with certain parts being shown in phantom lines.

FIG. 22 shows a portion of an intermediate sheet feeding device 301 located in the main body of a copying apparatus of a both-sides copying type, not shown, comprising a tray 303 to which a sheet 302 having an image printed on one side surface thereof is delivered in the direction of the arrow E. On the tray 303, the sheet 302 is brought into alignment with a reference disposed perpendicular to the direction E in which the sheet 302 is delivered by a sheet aligning device 304.

Figure 23:
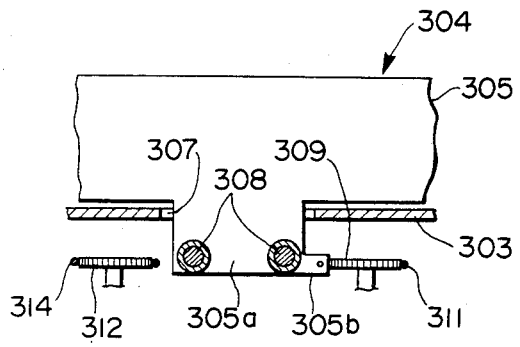
FIGS. 23–28 are views in explanation of the operation of the sheet aligning device, with the guide rods and other parts being removed.

The sheet aligning device 304 comprises a reference side wall 305 and a reciprocating side wall 306 extending in the direction E and spaced apart from each other widthwise F of the sheet 302 to allow the sheet 302 to be introduced into a space defined there between. In the embodiment shown and described, as shown in FIGS. 22 and 23, bases **305*a* and 306*a* of the side walls 305 and 306 respectively are fitted in a cutout 307 (see FIGS. 24–28) formed in the tray 303 and slidably supported on guide rods 308 secured to a lower portion of the tray 303. The guide rods 308 extend widthwise F of the sheet 302 to allow the side walls 305 and 306 to move widthwise of the sheet 302**.

The reference side wall 305 is secured as indicated at **305*b* to an endless chain 311 trained over a drive sprocket wheel 309 and a follower sprocket wheel 310. Likewise, the reciprocating side wall 306 is secured as indicated at 306*b* to an endless chain 314 trained over a drive sprocket wheel 312 and a follower sprocket wheel 313. The drive sprocket wheels 309 and 312 are driven for rotation by an actuating device, not shown, which comprise stepping motors for driving the side walls 305 and 306 separately and independently of each other. As the sprocket wheels 309 and 312 are driven for rotation, the side walls 305 and 306 can move widthwise F of the sheet 302** as described hereinabove.

The sheets 302 are fed from a main sheet feeding device, not shown, and delivered to a printing station juxtaposed against a photosensitive member, not shown, where they are printed and conveyed to a fixing device, not shown, in which the images formed on the sheets are fixed. From the fixing device, the sheets 302 are delivered to the tray 303 of the intermediate sheet feeding device 301. When trouble occurs in the path of travel of the sheets 302, they may not reach the tray 303. Thus, it is necessary to monitor the sheets 302 during its travel from the main sheet feeding device to the tray 303, and, if they fail to reach the tray 303, to detect their failure to reach the tray 303 and inform the operator to let him take necessary steps. The sheets 302 are delivered to the tray 303 in a predetermined number including one, and it is necessary to sense their arrival at the tray 303 to count their number. Also, as subsequently to be described, it is necessary to find out that the sheet 302 has been placed on the tray 303 to control the time at which the movement of the side walls 305 and 306 widthwise F of the sheet 302 is initiated to bring the sheet 302 into alignment as subsequently to be described.

To accomplish at least one of the aforesaid objects of detecting the sheet 302, the sheet aligning device 304 is equipped with detecting means comprising a reflection type photoelectric sensor including a light source 315 and a light receiving element 316 as shown in FIGS. 24–29. The sheet aligning device 304 operates as follows to enable the detecting means to detect the leading edge of a sheet.

When the sheet 302 designated by one-dot between two-dashed lines in FIGS. 22–29 enters the space defined between the reference side wall 105 and reciprocating side wall 306, the side walls 305 and 306 are disposed in standby or inoperative positions in which they are spaced apart from each other a greater distance that the width W of the sheet 302, so as not to interfere with the movement of the sheet 302. In this case, the reference side wall 305 is disposed outwardly, by a distance $L_4$, of a reference position X for finally positioning the sheet 302 widthwise of the reference position X on the tray 303.

Figure 26:
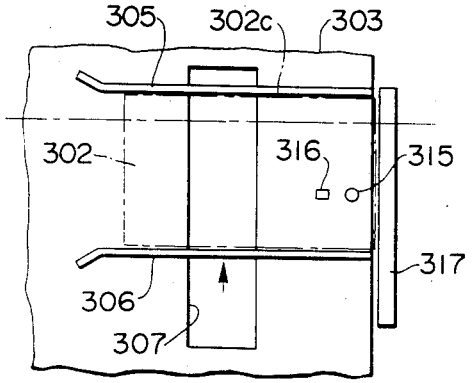

At a suitable time after the sheet 302 has started to enter the space on the tray 303 between the side walls 305 and 306 after having moved in the direction E, the drive sprocket wheel 312 is driven for rotation by the stepping motor counterclockwise in FIG. 22 to move the reciprocating side wall 306 toward one lateral side **302*b* of the sheet 302, when a leading edge 302*a* of the sheet 302 impinges on a front striking bar 317 secured to the front (rightside of tray in FIG. 24) of the tray 303 as shown in FIGS. 24–28 and stops. Thus, the reciprocating side wall 306 is moved and forced against the sheet 302 until an opposite lateral side 302*c* of the sheet 302 is brought into contact with the reference side wall 305 located in the standby position as shown in FIG. 26**.

Figure 24:
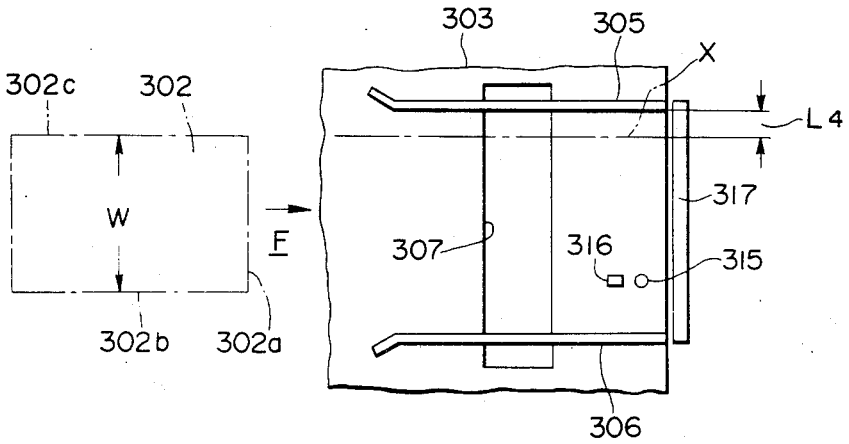
Figure 25:
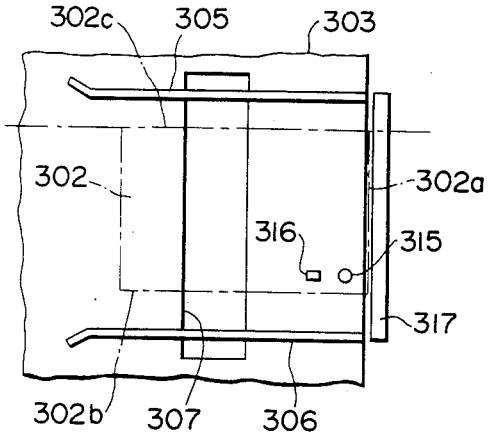
Figure 27:
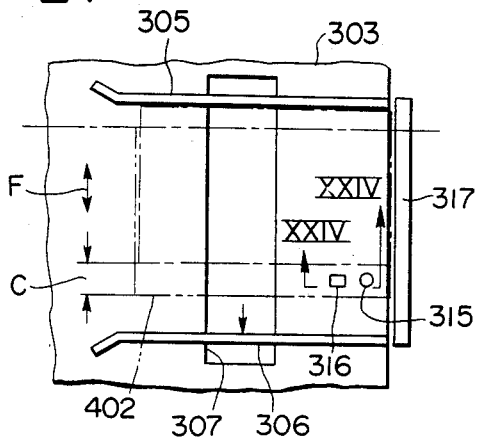
Figure 28:
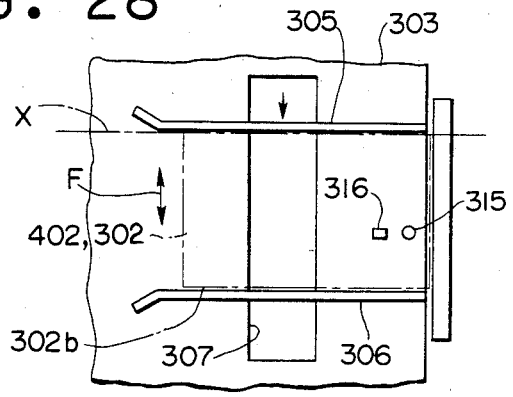

Then, the drive sprocket wheel 312 (FIG. 22) is rotated in the reverse direction to move the reciprocating side wall 306 back, as shown in FIG. 27, to the inoperative or standby position which is also shown in FIG. 24, with a result that the side walls 305 and 306 are spaced apart a great distance from each other again, to allow the next following sheet conveyed at an interval to the preceding sheet 302 to enter the space between the side walls 305 and 306. The next following sheet is designated by two-dots between two-dashed lines in FIG. 27 and designated by the reference numeral 402. When the next following sheet 402 enters the space between the two side walls 305 and 306, it is displaced by a magnitude C widthwise F of the preceding sheet 302.

Like the preceding sheet 302, the next following sheet 402 is forced by the reciprocating side wall 306 against the reference side wall 305 and stacked on the preceding sheet 302.

The aforesaid operation is repeatedly performed each time the sheet is fed to the tray 33. When a predetermined number of sheets have been stacked on the tray 303, the drive sprocket wheel 309 is rotated counterclockwise in FIG. 22 to move the reference side wall 305 to the reference position X shown in FIG. 28, to bring the sheets on the tray 303 into alignment with the reference position X widthwise thereof. Thus, the sheets are positioned in a final reference position. Then, the sheets on the tray 303 are fed one by one by a sheet feeding roller, not shown, to the photosensitive member again. Since the sheets have been aligned widthwise F thereof with respect to the reference position X, it is possible to positively move the sheets to a desired position in the printing station juxtaposed against the developed image on the photosensitive member. When the sheets on the tray 303 are fed again therefrom to the photosensitive member, the reciprocating side wall 306 is preferably brought into contact with the lateral side 302*b* of the sheets or moved to a position close to the lateral side 302*b*, to ensure that the sheets are positively guided.

Figure 29:
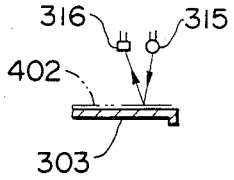
FIG. 29 is a sectional view taken along the line XVIII—XVIII in FIG. 27.

The sheets are brought into alignment with the reference position X as described hereinabove. Before the reciprocating side wall 306 begins to move force the sheet 402 newly delivered to the tray 303 against the reference side wall 305, the sheet 402 is displaced widthwise F by a magnitude C from the sheets 302 already disposed in the predetermined position or projects downwardly in FIG. 27. A zone into which the sheet 402 projects will be referred to as a projecting zone C. The light source 315 and light receiving element 316 referred to hereinabove are located in the projecting zone C to detect the sheet which might project thereinto. More specifically, a top surface of the tray 303 has a low light reflecting rate, so that light emanating from the light source 315 is absorbed by the top surface of the tray 303 when no sheet exists in the projecting zone C and almost no light is incident on the light receiving element 316. However, as shown in FIGS. 27 and 29, when the next following sheet 402 enters the space between the side walls 305 and 306 and the sheet 402 projects into the projecting zone C, the light emitted by the light source 315 is reflected by the sheet 402 and incident on the light receiving element 316. Thus, the entry of the sheet 402 into the tray 303 is positively detected. The entry of the preceding sheet 302 is, of course detected in like manner (see FIG. 25).

The detecting means described hereinabove may be immovably secured to the sheet aligning device. In the embodiment shown and described hereinabove, however, the reflecting type photoelectric sensor including the light source 316 and light receiving element 316 is mounted on the reciprocating side wall 306 through a connector, not shown, for movement as a unit with the side wall 306. This arrangement offers the following advantages.

The size of the sheets used in a copying apparatus is usually selected by the operator, so that a variety of sizes of sheets are used. Thus, the sheets delivered to the intermediate sheet feeding device vary in size depending on the desire of the operator. Because of this, when the standby position of the reference side wall 305 remains unchanged, the position of the reference side wall 305 remains unchanged, widthwise F of the sheets depending on the size of the sheets delivered successively to the tray 303. detecting means were immovably installed, it might be impossible to detect the entry of the sheet in the projecting zone C in the event of the size of the sheet was too small. To obviate this disadvantage, the detecting means may comprise a plurality of reflecting type photoelectric sensors arranged widthwise F of the sheets, to enable to entry of the sheet of any size in the projecting zone C to be detected, in spite of a change in the position of the projecting zone C. However, this would cause a rise in costs. In the embodiment shown and described hereinabove, the detecting means is moveable together with the reciprocating side wall 306 as a unit, so that it is possible to detect without fail the entry of the sheet in the projecting zone C by the detecting means in spite of a change in the position of the projecting zone C merely by altering the standby position of the reciprocating side wall 306 widthwise F of the sheets in accordance with the size of the sheets handled to thereby alter the position of the detecting means when the sheet enters the space between the two side walls on the tray.

It would not be essential to secure the detecting means to the reciprocating side wall 306, if it is possible to detect the entry of a copy sheet in the projecting zone C without fail by altering the position of the detecting means each time the position of the projecting zone C changes. Alternatively, the standby position of the reference side wall 305 may be altered widthwise F of the sheet each time the size of the sheets handled changes, to keep the position of the projecting zone C constant irrespective of the size of the sheets to enable the immovably fixed detecting means, to detect the entry of the sheet in the space between the side walls 305 and 306.

In the embodiment shown and described hereinabove, the entry of sheets in the space between the side walls 305 and 306 is detected when the sheets are conveyed in the direction E in which they are conveyed. Alternatively, the sheet may be detected by a detecting means which is movable with the reciprocating side wall 306 as a unit when the latter is moved to force the sheet against the reference side wall 305. This eliminates the need to alter the standby position of the reciprocating side wall 306 depending on the size of the sheets handled. However, it is not possible to use the projecting zone C when the sheet is detected for the purpose of controlling the timing with which the operation of the reciprocating side wall 306 is commenced, because the sheet is detected after the operation of the reciprocating side wall 306 has begun.

As described hereinabove, the sheets are usually aligned widthwise F by using two references. One reference is a center reference line G (FIG. 2) and the other reference is a one-side reference. When the sheets are aligned according to one-side reference in the embodiment shown in FIGS. 24–28, it is not necessary to alter the reference position X depending on the size of the sheets. However, when the sheets are aligned in accordance with the center reference, one only has to alter the reference position X widthwise of the sheets depending on their size.

The construction of the embodiment shown in the drawings may further be modified. For example, in place of using a reflecting type photoelectric sensor 315, 316, a permeating type photoelectric sensor including a tray formed with light permeating apertures, a light source located on one side of the tray and a light receiving element located on an opposite side of the tray. Alternatively, detecting means having an actuator driven by a sheet may be used.

What is claimed is:

1. A sheet aligning device comprising a pair of side walls located on opposite sides of sheets successively delivered at intervals, at least one of said side walls being movable in reciprocatory movement to bring the sheets into alignment with each other widthwise thereof which is perpendicular to the direction in which the sheets are delivered, wherein the improvement comprises:

detecting means for detecting, before the sheets are aligned widthwise thereof, a displacement of each of the sheets widthwise thereof while the sheet remains aligned with a reference line lengthwise of the sheets and a displacement of each of the sheets in which the sheet is skewed with respect to the reference line, said detecting means producing an output for altering at least one of the frequency, speed and stroke of the reciprocatory movement of at least one side wall when a sheet aligning operation is performed.

2. A sheet aligning device as claimed in claim 1 mounted in association with a tray on which the sheets are stacked, wherein at least one reciprocating side wall moves across the tray on which the sheets are stacked.

3. A sheet aligning device as claimed in claim 1 or 2, wherein said detecting means is located on an upstream side of the tray with respect to the direction in which the sheets are delivered to the tray.

4. A sheet aligning device as claimed in claim 3, further comprising another detecting means for checking the condition of the sheets following the side wall sheet aligning operation.

5. A sheet aligning device according to claim 1, wherein the detecting means comprises first and second detectors which respectively detect skewing and widthwise displacement of the sheets relative to the side walls;

said first detector including first and second photoelectric sensors which respectively include first and second light sources and first and second light receiving elements, said first light source and said first receiving element and said second light source and said second receiving element, respectively, being arranged in juxtaposed relation;

said second detector including a plurality of photoelectric sensors, each sensor including a light source and a juxtoposed light receiving element, said plurality of sensors being located in a plane perpendicular to the direction in which the sheets are conveyed.

* * * * *